US008562245B2

(12) United States Patent
Hasch

(10) Patent No.: US 8,562,245 B2
(45) Date of Patent: Oct. 22, 2013

(54) KERBSTONE AND STOP FOR BUS TRAFFIC

(75) Inventor: Wolfgang Hasch, Wabern (DE)

(73) Assignee: Profilbeton GmbH, Borken (DE)

( * ) Notice: Subject to any disclaimer, the term of this patent is extended or adjusted under 35 U.S.C. 154(b) by 0 days.

(21) Appl. No.: 13/640,661

(22) PCT Filed: Apr. 8, 2011

(86) PCT No.: PCT/EP2011/055535

§ 371 (c)(1),
(2), (4) Date: Nov. 20, 2012

(87) PCT Pub. No.: WO2011/128270

PCT Pub. Date: Oct. 20, 2011

(65) Prior Publication Data

US 2013/0058714 A1 Mar. 7, 2013

(30) Foreign Application Priority Data

Apr. 12, 2010 (DE) ..... 20 2010 005 173 U

(51) Int. Cl.
*E01C 11/22* (2006.01)

(52) U.S. Cl.
USPC ..... 404/7

(58) Field of Classification Search
CPC ..... E01C 11/222
USPC ..... 404/2, 6, 7
See application file for complete search history.

(56) References Cited

U.S. PATENT DOCUMENTS 530,988 A * 12/1894 Fry et al. ..... 404/7
1,170,452 A * 2/1916 Lipp ..... 249/9
3,232,187 A * 2/1966 Brigham ..... 404/7
3,837,756 A * 9/1974 Schwarz ..... 404/70
7,641,420 B2 * 1/2010 Becker et al. ..... 404/107
2007/0098491 A1 * 5/2007 Kochling ..... 404/7

FOREIGN PATENT DOCUMENTS

| | | |
|---|---|---|
| DE | 28 20 545 | 11/1979 |
| DE | 90 17 267 | 10/1991 |
| DE | 91 14 667 | 4/1992 |
| DE | 297 12 342 | 10/1997 |
| EP | 0 544 202 | 6/1993 |
| EP | 0 892 112 | 1/1999 |
| FR | 759 574 | 2/1934 |
| GB | 1 262 476 | 2/1972 |
| NL | 2001105 | 6/2009 |
| WO | 2008/111769 | 9/2008 |

* cited by examiner

*Primary Examiner* — Raymond W Addie
(74) *Attorney, Agent, or Firm* — Michael J. Striker

(57) ABSTRACT

A curbstone (6, 7, 9, 10) comprising an upper side (63, 73, 93, 103) serving as a step-on surface, a front side (64, 74, 94, 104) serving as a boundary, a rear side (61, 71, 91, 101) and a lower side (62, 72, 92, 102), wherein the front side (64, 74, 94, 104) comprises a lower mounting section (641, 741, 941, 1041) with an upper edge (642, 742, 942, 1042) and, adjoining the upper edge (642, 742, 942, 1042), an upper section which is provided with an oblique surface (645, 745, 945, 1045) which is set back increasingly from bottom to top in the direction of the rear side (61, 71, 91, 101) and which, in its lower region, merges into a concavely curved section (644, 744, 944, 1044) which extends as far as the upper edge (642, 742, 942, 1042) in a substantially planar section (643, 743, 943, 1043) extending virtually horizontally in the mounted state, wherein the front side (64, 74, 94, 104) comprises, above the oblique surface (645, 745, 945, 1045), a second concavely curved section (647, 747, 947, 1047) which is set back increasingly from bottom to top in the direction of the rear side (61, 71, 91, 101).

15 Claims, 8 Drawing Sheets

KERBSTONE AND STOP FOR BUS TRAFFIC

CROSS-REFERENCE TO A RELATED APPLICATION

Figures 1, 2:
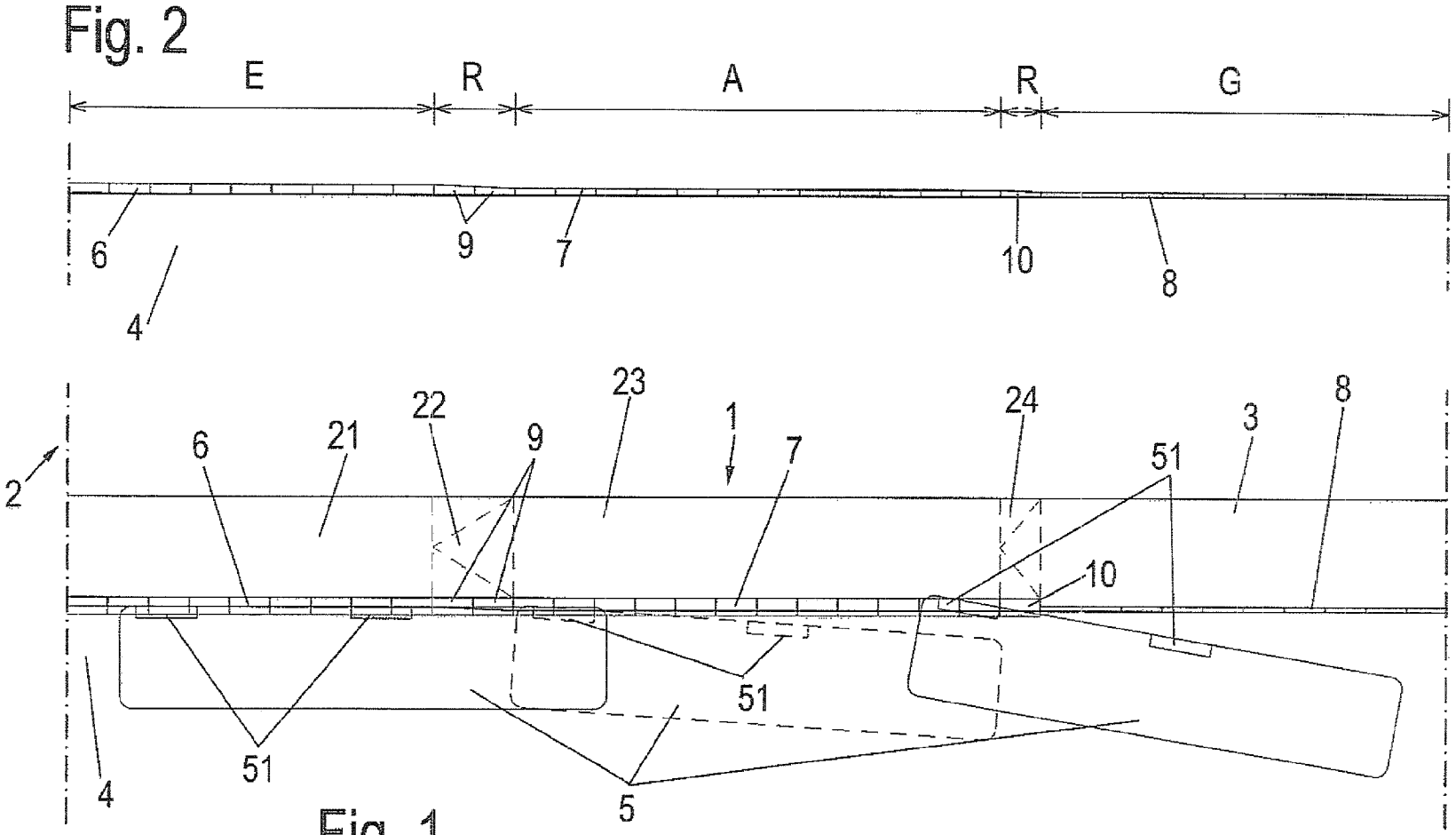

The invention described and claimed hereinbelow is also described in German patent Application 20 2010 005 173.8 filed on Apr. 12, 2010. This German Patent Application, whose subject matter is incorporated here by reference, provides the basis for a claim of priority of invention under 35 U.S.C. 119 (a)-(d).

The present invention relates to a curbstone according to the preamble of Claim 1 and a stop for bus traffic.

A curbstone according to the preamble and bus stops or combined bus/tram bus stops equipped with such curbstones are known from the prior art. Thus, for example, a curbstone having a top side used as a step-on surface and a front side used as the delimitation to the road or roadway of a bus is described in EP 0 544 202 B1, which is partially embedded in the road in the installed state and is provided with an edge provided at the height of the road level having an inclined surface set back from bottom to top increasingly in the direction of the rear side of the curbstone, which merges into its lower region into a concavely curved section, which extends in a substantially level section, which extends nearly horizontally in the installed state, up to the top edge of the region of the front side of the curbstone embedded in the road. It is thus ensured that buses which approach the stop approximately parallel are reliably guided into an optimum entry position for the passengers and damage to the tire flanks of the bus tires is effectively prevented.

However, if the approach to the stop of a bus does not occur approximately parallel, for example, if vehicles are parked in the stop region or the stop is designed as a bus bay, the vehicle body of the bus can contact the curbstones during the approach to the stop and therefore damage can occur to the bus and/or the curbstone. The bus part located in front of the front axle of such a bus, which can be more than 2 m long depending on the type of bus, can pass over the stop or the curbstone even at a small approach angle, before the front axle is guided parallel by the typical curbstone. The height of the tire profile, the tire pressure, the load status, and a spring compression of the bus during a braking procedure are decisive for the free space below the bus. An additional reduction of this free space can be caused, for example, by ruts or paved gutters in the roadway for rainwater drainage.

Experiences in the building of stops having greatly varying entry heights have shown that a contact of the bus body with the stop is precluded at structural heights of the curbstone of at most 16 cm height.

However, a significantly higher stop level is desirable with respect to a barrier-free entry into the bus.

For this purpose, a delimitation of a roadway for combined bus/tram stops is known from EP 0 892 112 B1, in which the curbstone has a special recess, which provides a minimal advantageous free space with respect to safety for specially selected buses after the approach to the approach surface, the plane of the top side of the curbstone lying almost in the plane of the entry height of specially selected rail vehicles. The front edge of the curbstone, which is significant for buses, is only slightly offset from the approach surface of the curbstone by the recess disclosed here, however, since the extension of the inclined approach surface up to the front edge of the top side is incident nearly at the same point.

In the case of an inclined approach of buses to the approach surface, the risk of contact of the bus body on the curbstone is only inadequately reduced by this recess.

From fear of contacting the curbstone and damaging the bus and the curbstone, many bus drivers still drive toward the bus stop at a significant distance therefrom, so that a large gap remains between the bus and the curbstone of the stop, which makes it more difficult for the passengers to enter and exit.

The object of the present invention is therefore to provide a curbstone and a bus stop, using which contact-free approach and barrier-free entry into a bus are made possible.

This object is achieved by a curbstone having the features of Claim 1 and by a bus stop having the features of Claim 10.

In the curbstone according to the invention, the front side above the inclined surface has a second concavely curved section which is set back from bottom to top increasingly in the direction of the rear side of the curbstone. An approach of the bus to the stop at a greater approach angle is thus made possible.

In addition, the fear of the bus driver of contacting the curbstone when driving toward the stop too closely and damaging the bus and the curbstone is significantly reduced by the curbstones formed according to the invention, since the horizontal distance between the inclined surface contacted by the wheels of the bus and the edge of the top side is formed so large that the bus driver seeks the contact of the bus wheels with the approach surface, the gap between the bus entry and the curbstone of the stop is thus minimized, and it is thus made easier for the passengers to enter or exit.

Advantageous embodiments of the invention are the subject matter of the subclaims.

According to an advantageous embodiment of the invention, the inclined surface of the front side merges via a convexly curved section into the second convexly curved section. The danger of damage to the tire flank or climbing of the bus wheel onto the stop is thus significantly reduced in relation to an implementation of this transition in a horizontal surface.

According to the requirement for the height of the curbstone with respect to the barrier-free transition into the bus, the second concavely curved section can merge in the direction of the top side into a second inclined surface and therefrom, preferably via a convexly curved section, into the top side of the curbstone. Particularly large height differences can thus also be overcome in a simple manner.

Through the features of the stop formed according to the invention, in particular in the case of a combined train/bus stop, a barrier-free, comfortable access to the bus or the (tram) train and safe approach of a bus to the stop are ensured.

Figure 3:
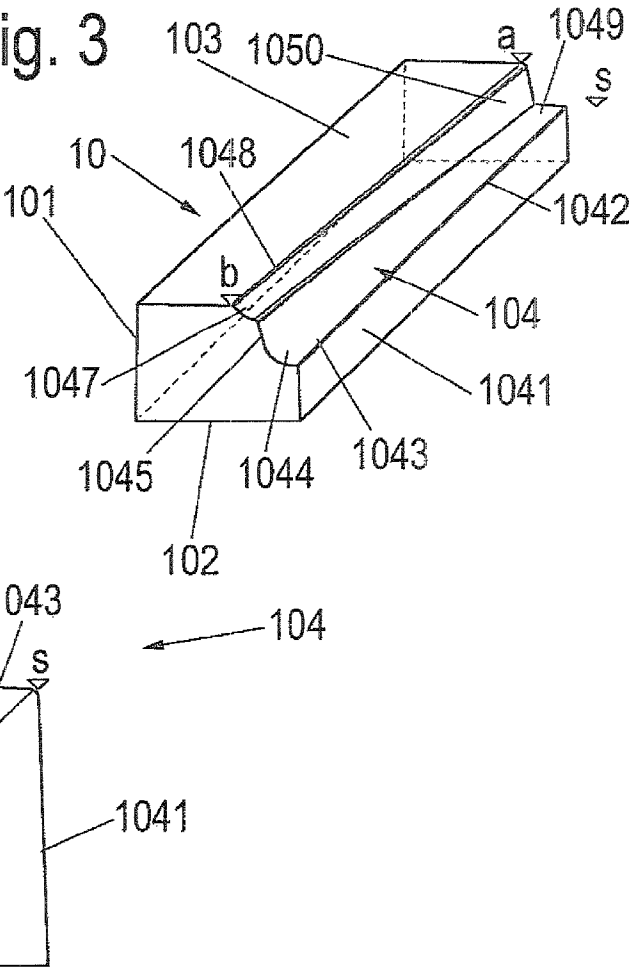
Figure 4:
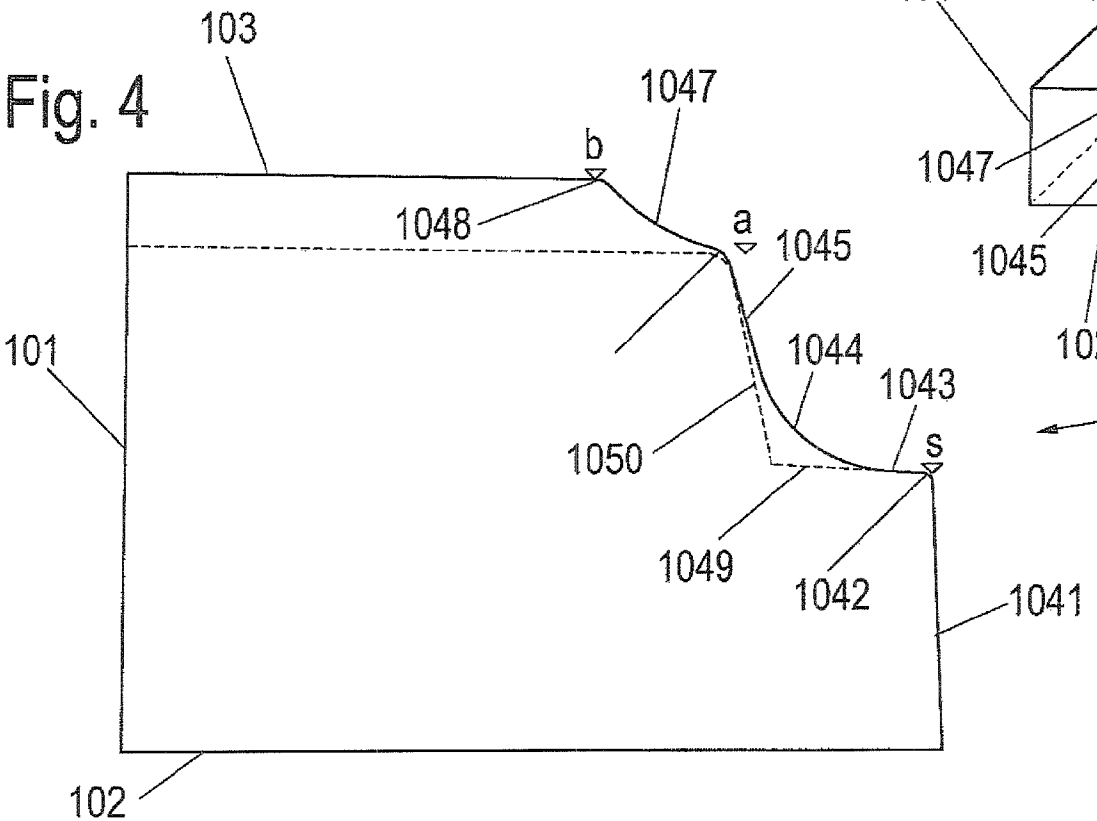
Figure 5:
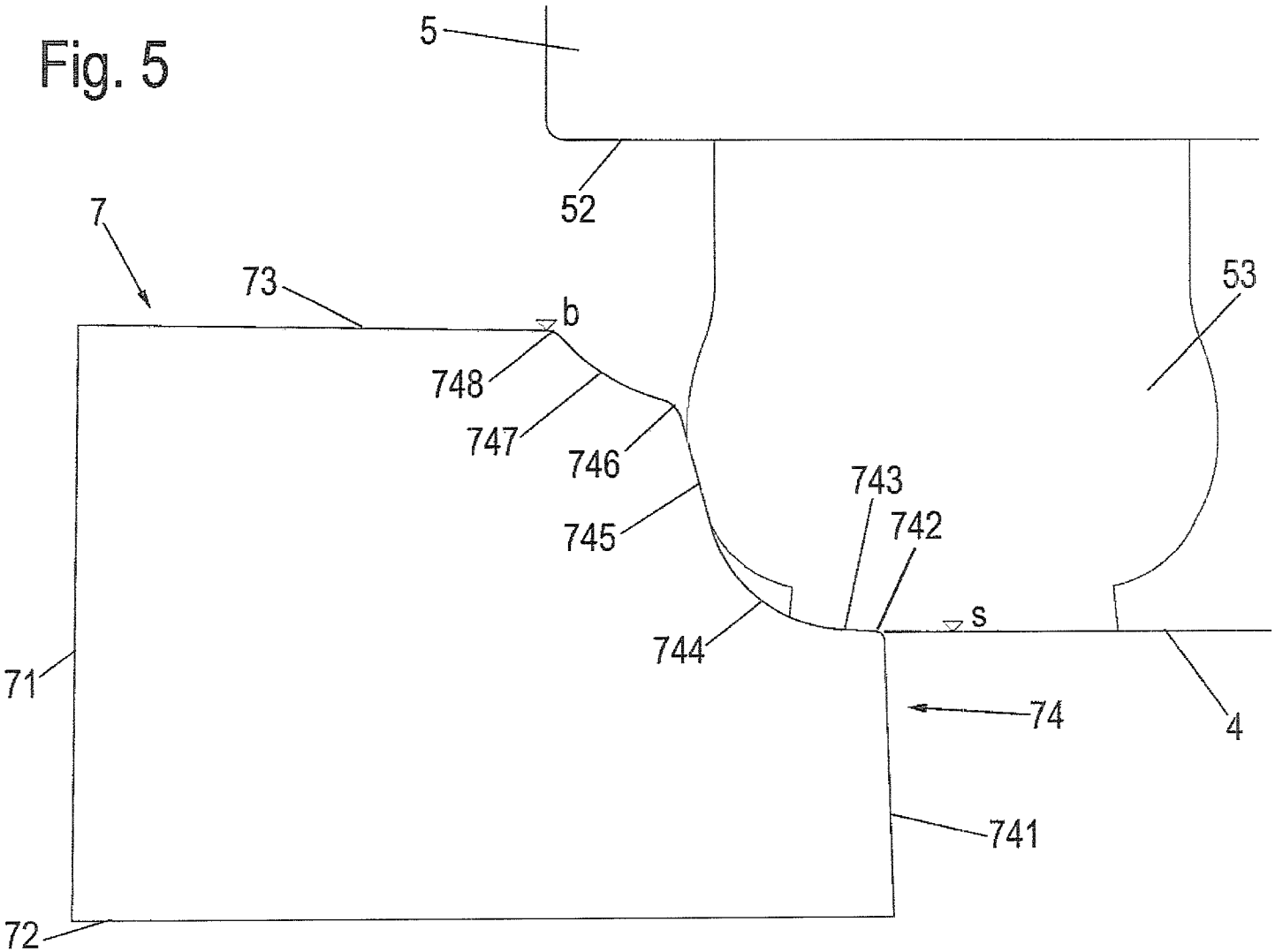
Figure 6:
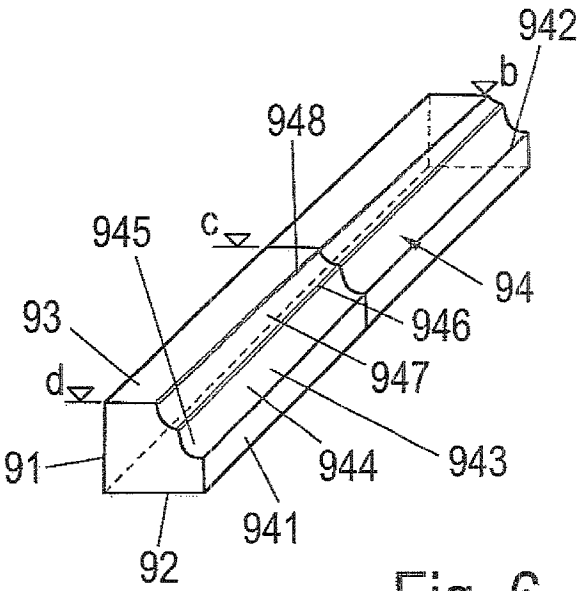
Figure 7:
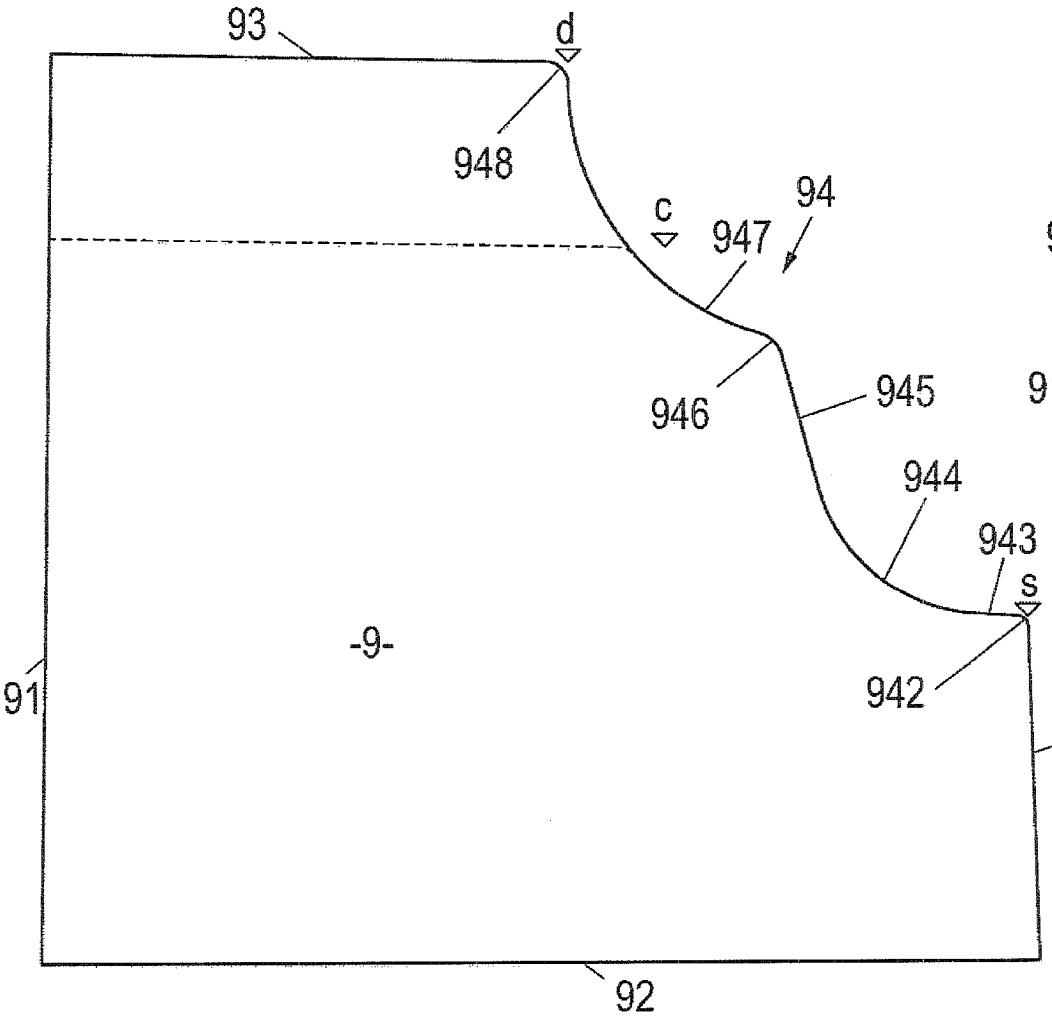
Figure 8:
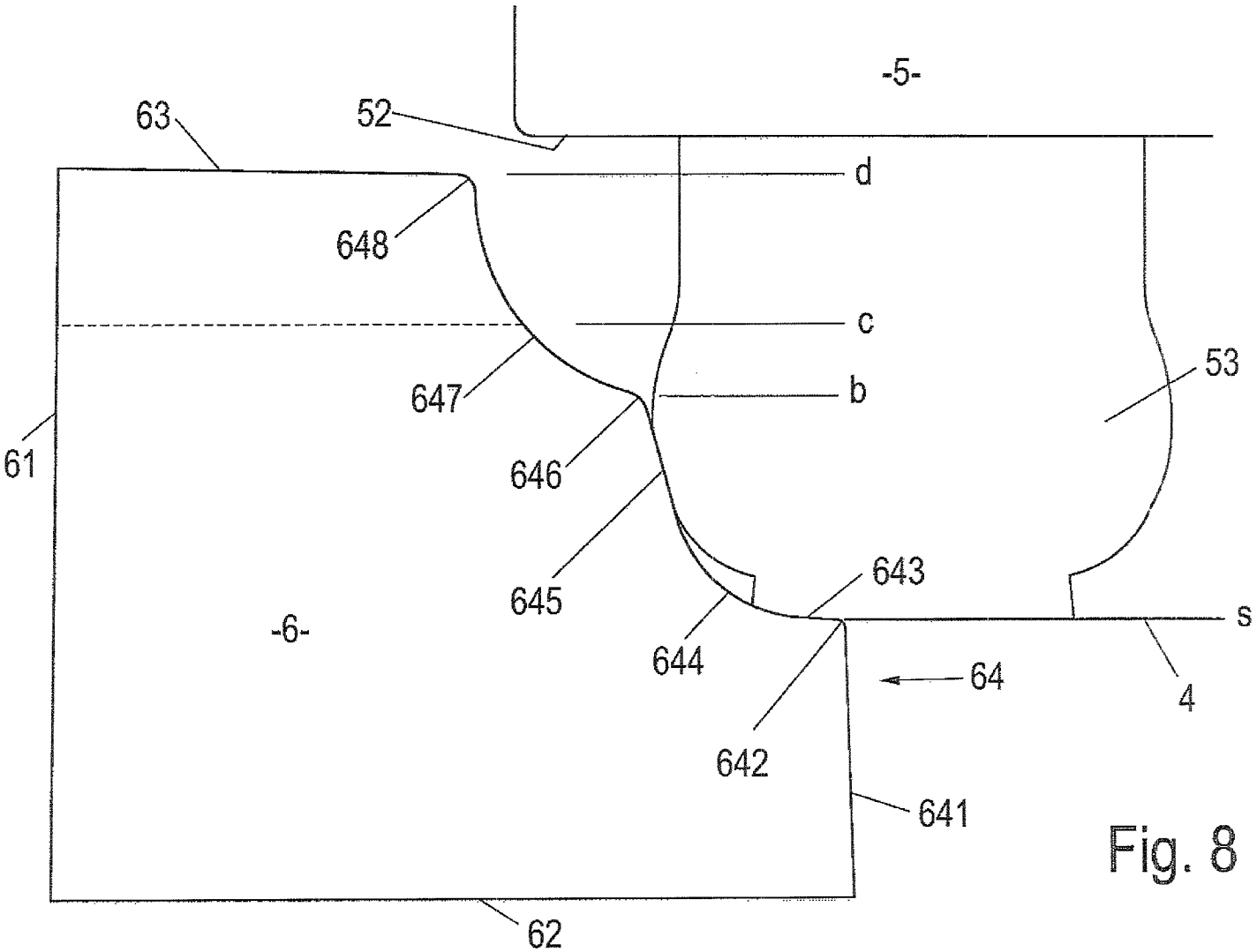
Figure 9:
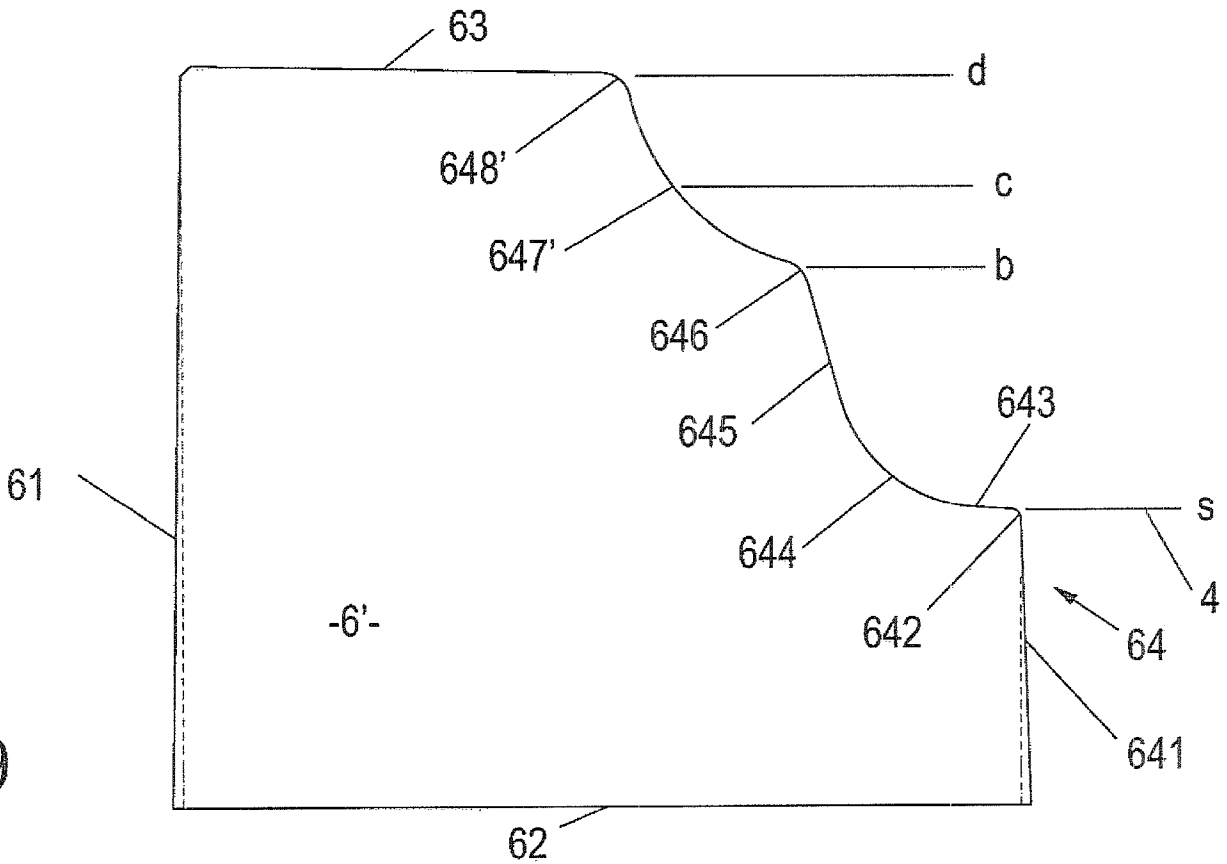
Figure 10:
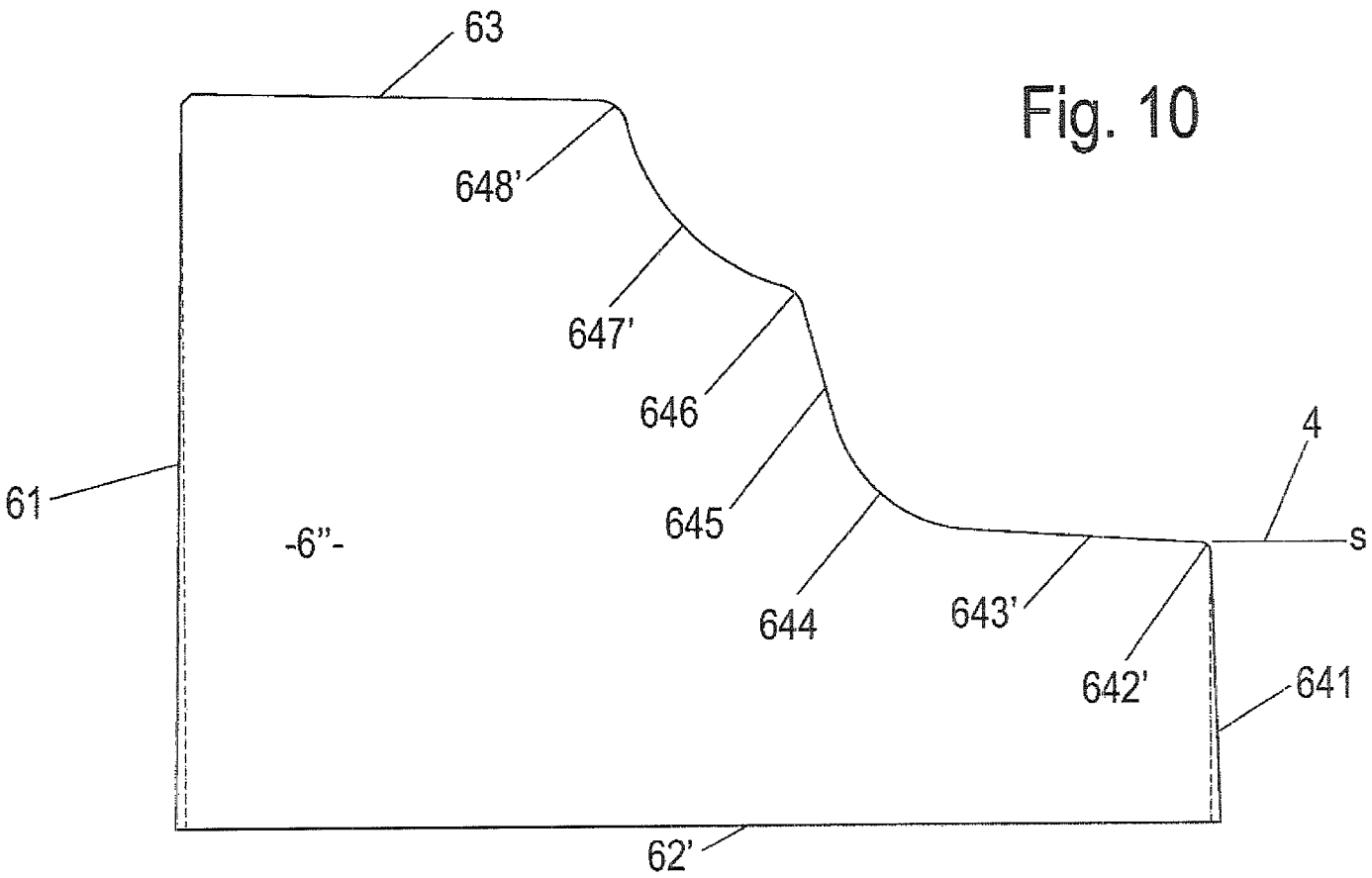
Figure 11:
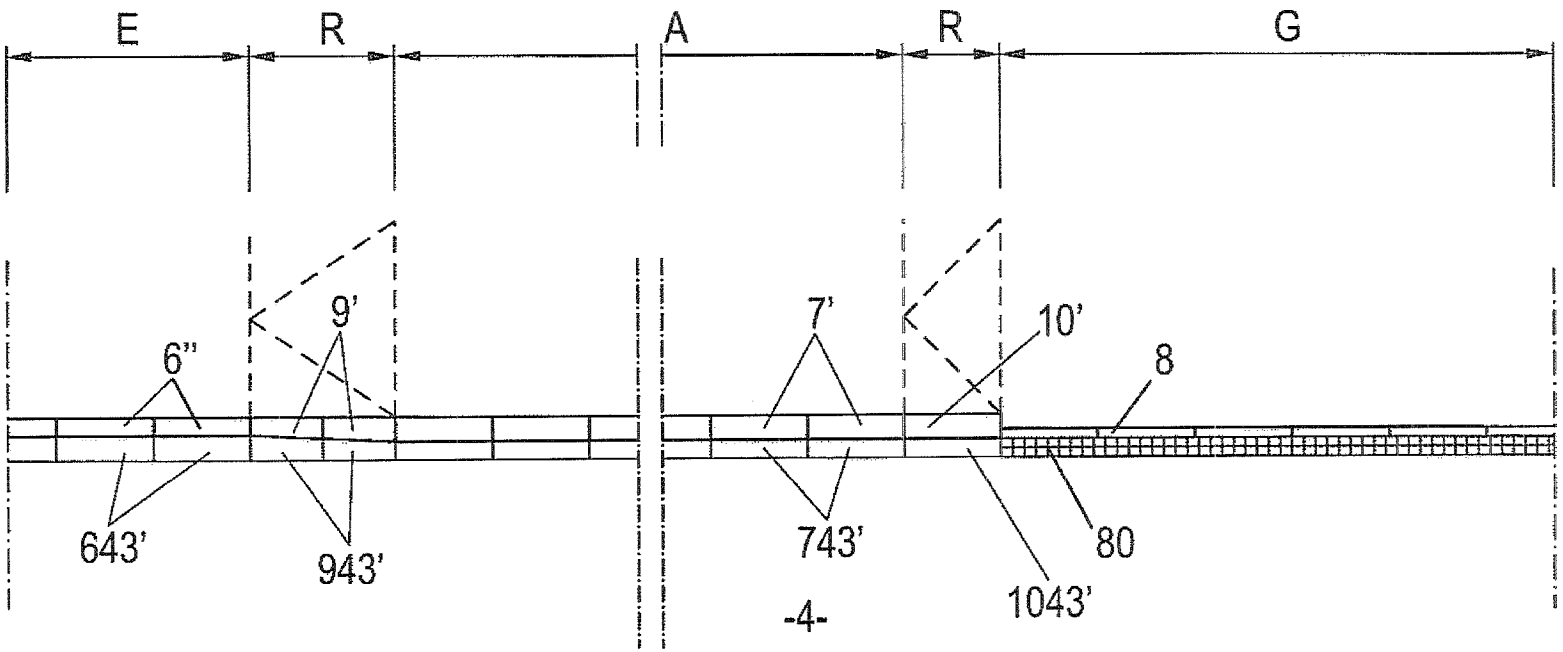

Exemplary embodiments of the invention are explained in greater detail hereafter on the basis of the appended drawings. In the figures:

FIG. 1 shows a top view of a part of an embodiment variant of a stop according to the invention, FIG. 2 shows a cross section from the front of the stop shown in FIG. 1, FIG. 3 shows a perspective view of an embodiment variant of a curbstone according to the invention for installation on a ramp between a sidewalk and an approach region of the stop, which is elevated in relation to the sidewalk, FIG. 4 shows an enlarged cross section through the curbstone shown in FIG. 3, FIG. 5 shows a cross section through the curbstone shown in FIG. 3 in conjunction with a wheel and the vehicle body bottom side of a bus, FIG. 6 shows a perspective view of two assembled curbstones for installation on a ramp between the approach region and the entry region of the stop, FIG. 7 shows a cross section through the curbstone from FIG. 6 in the region of the end of the curbstone close to the entry region, FIG. 8 shows a cross section through the curbstone from FIG. 6 in conjunction with a wheel and the vehicle body of a bus, FIG. 9 shows a cross-sectional view of a curbstone modified in relation to FIG. 8, FIG. 10 shows a cross-sectional view of a further embodiment of a curbstone modified in relation to FIG. 8, and FIG. 11 shows a top view of a stop according to the second exemplary embodiment.

In the following description of the figures, terms such as top, bottom, left, right, front, rear, etc. refer exclusively to the exemplary illustration and position of the curbstone and other components of the bus stop selected in the respective figures. These terms are not to be understood as restrictive, i.e., these references can change through different working positions or mirror-symmetric design or the like.

In FIG. 1, a bus stop is designated as a whole by the reference sign 1, which is provided adjacent to a roadway 4, which is arranged parallel to the stop 1 and has an elevated surface 2 in relation to the roadway 4, which is delimited to the roadway 4 using curbstones 6, 7, 8, 9, 10 arranged one behind another.

The surface 2 of the bus stop 1 has an approach region A having a walkway 23, which is elevated in relation to a walkway 3 of a sidewalk region G adjoining the stop, and an entry region E having a walkway 21, which is elevated in relation to the walkway 23 of the approach region A. Ramps R having walkways 22, 24 are respectively provided between the walkways 3, 23 of the sidewalk region G and the approach region A and between the walkways 21, 23 of the approach region A and the entry region E, in order to also allow handicapped persons easy access to the entry region E of the stop. The height of the walkway 23 of the approach region A in relation to the level of the roadway 4 is preferably limited to 16 cm and preferably has a length of approximately 8 m to 15 m in the travel direction of the roadway 4. The transition from the walkway 23 of the approach region A to the walkway 21 of the entry region E occurs via a ramp R, whose walkway has a slope of preferably at most 6%, the walkway 21 of the entry region then being located at a height of preferably greater than 18 cm over the level of the roadway 4. The entry into a bus 5 stopping at the stop 1 is also possible in the approach region A of the stop 1, of course, but with a greater step height than is the case in the entry region E.

As shown in FIG. 2, the curbstones 6, 7, 8, 9, 10 used as the delimitation to the roadway 4 are formed according to the respective height level of the different regions of the stop 1. A typical curbstone is designated by the reference sign 8, which is used as the delimitation between the roadway 4 and a sidewalk G, the sidewalk G lying at a level of 12 cm over the level of the roadway 4, for example, and the typical curbstone accordingly protruding upward 12 cm from the roadway 4 in the installed state, in order to terminate flush with the walkway 3 of the sidewalk G. Other sidewalk levels are also conceivable, of course.

The curbstone designated by the reference sign 10 is shown in detail in FIGS. 3 and 4. This curbstone 10 preferably consists, like typical curbstones, of approximately cuboid concrete finished component. Production from natural or artificial stone is also possible, however. The curbstone 10 has a top side 103 used as a step-on surface, a front side 104 used as a delimitation, a rear side 101, a bottom side 102, and two end sides, the rear side 101 and the bottom side 102 being substantially intended for support on a (concrete) foundation or for gluing. The top side 103 terminates substantially flush with the top side of the ramp 24 of the surface 2 of the stop 1 in the installed state of the curbstone 10. The top side 103 of the curbstone 10 merges on its end facing toward the roadway 4 via a preferably convexly curved section 1048, which simultaneously defines the stop top edge and which has a small radius of curvature of 15 mm, for example, and is used for the purpose of avoiding sharp edges which can easily break off, into the front side 104 of the curbstone.

The front side 104 merges on its end close to the curbstone 8 mounted in front of the sidewalk G via the curved section 1048 into an inclined surface 1050, which is adjoined by a horizontally aligned plane 1049, which is at the height of the roadway 4 in the installed state of the curbstone 10. This plane 1049 then merges via a broken, preferably rounded or chamfered edge 1042, into a bottom section 1041 embedded in the foundation concrete layer of the roadway 4.

At the end of the curbstone 10 close to the approach region A, the top side 103 merges via the convex curved section 1048 into a concavely formed section 1047. This concavely curved section 1047 preferably has a radius of 80 to 120 mm and preferably extends over an arc of 10° to 30°. The height difference between the top end of the section 1047 and the bottom end of this section is preferably approximately 4 cm.

The shaping of this top section of the curbstone 10 merges from the formation having the inclined surface 1050 and the horizontally aligned plane 1049, at the end of the curbstone 10 close to the curbstone 8 of the sidewalk G in the direction of the end side of the curbstone 10 facing toward the approach region A, continuously into the formation having the concavely formed section 1047 at the end of the curbstone 10 close to the approach region A.

The concavely curved section 1047 then merges in the direction of the roadway via a convex transition having a radius of preferably 1 to 2 cm into an inclined surface 1045, preferably having a slope of 65 to 85°, which is set back in a known manner increasingly from bottom to top in the direction of the rear side 101 and which merges in its bottom region into a concavely curved section 1044, which extends in the substantially level section 1043, which extends nearly horizontally in the installed state, up to the convex curved section 1042 of the lower installed section 1041. The concavely curved section 1044 provided below the inclined surface 1045 has a radius of preferably 50 to 100 mm, in particular 75 mm. The section formed with such a radius is well adapted to the curved section of the outer contour of a typical bus tire 53.

FIG. 5 shows a curbstone 7 which delimits the surface 2 of the stop 1 toward the roadway 4 in the approach region A. In this curbstone 7, the front side 74 facing toward the roadway is formed continuously corresponding to the front side 104 of the curbstone 10 on its end facing toward the approach region A. Accordingly, it has a lower installation section 741, which, in the installed state of the curbstone 7, terminates at roadway level S with a top edge 742 preferably formed as a convex curved section 1042. A top section adjoins this top edge 742, which is provided with an inclined surface 745 increasingly set back from bottom to top in the direction of the rear side 71, which merges in its bottom region into a concavely curved section 744, which extends in a substantially level section 743, which extends nearly horizontally in the installed state, up to the top edge 742, and has a second concavely curved section 747, which is set back increasingly from bottom to top in the direction of the rear side 71, formed above the inclined surface 745, which merges via a convexly curved section 748 into the top side 73, the inclined surface 745 merging via a convexly curved section 746 into the second convexly curved section 747. The top side 73 of the curbstone 7 preferably lies 16 cm above the level S of the roadway 4 in the installed state.

The curbstones shown in FIGS. 6 to 8 are used, in the case of the curbstones 9 shown in FIGS. 6 and 7, for delimiting the ramp R between approach region and entry region E to the roadway 4 and, in the case of the curbstone 6 shown in FIG. 8, for delimiting the entry region E to the roadway 4, in these curbstones 6, 9, the bottom region of the front side 64, 94 being formed by the installed section 641, 941 via the top edge 642, 942 and the adjoining sections 643, 644, 645, 646, 043, 944, 945, and 946 adjoining thereon, like the bottom region of the front side 74 of the curbstone 7.

The concavely curved section 647, 947 adjoining the second convexly curved section 646, 946 widens further in the case of the curbstone 9 in the direction of the entry region E, i.e., with the continuous rise of the top side 93 of the curbstone 9 along the walkway 22 of the ramp R to the level of the top side 63 of the curbstone 6, which is installed in the region of the entry region E, the convexly curved section 948 formed as the edge of the top side 93 is set back further in the direction of the rear side 91 of the curbstone 9, viewed in the direction of the entry region E. This is achieved in that the convexly curved section 646 has a radius of 80 to 120 mm. Depending on the level to be reached of the top side 63 of the curbstone 6, the second concavely curved section 647, 947 can merge in the direction of the top side 63, 93 into a second inclined surface. Level heights of greater than 20 cm above the level S of the roadway 4 are therefore also possible, without causing an excessively large gap to result between bus entry and top side of the curbstone 6 or without the second concavely curved section 647 being extended so far that the edge of the top side 63 is farther away from the rear side 61 of the curbstone in the direction of the roadway 4.

Using curbstones formed in this manner or a stop for bus traffic formed using such curbstones, a safe approach of a bus to such a stop is possible without risking a collision of the vehicle body 52 of the bus 5 with the curbstones 6, 7, 9, 10. The curbstones 6 in the entry region are formed so that barrier-free entry into the bus is made possible.

FIG. 9 shows a curbstone 6' modified in relation to FIG. 8, in which a concavely curved section 647' is arranged between the top first convexly curved section 648' and the second convexly curved section 646. The concavely curved section 647' is located between the level b of the approach region and the level d of the entry region and is formed somewhat flatter than in the exemplary embodiment of FIG. 8. The concavely curved section 647' therefore does not have a horizontal face or a vertical face, but rather is arranged inclined in relation to the horizontal in the bottom region, for example, at an angle of greater than 8°, and is also formed inclined to the vertical in the top region, for example, in a range greater than 8°. The radius of the concavely curved sections 647' can be formed in a range between 8 cm and 15 cm, in particular 10 to 12 cm.

The curbstone 6' is otherwise formed corresponding to the curbstone 6 of FIG. 8.

A further exemplary embodiment of a curbstone 6" is shown in FIG. 10, which is formed modified in the bottom region in relation to the curbstone 6' shown in FIG. 9. Proceeding from the concavely curved section 644, which has an arch between 5 cm and 10 cm, in particular 7 cm 8 cm, a section 643', which extends toward the roadway 4 and is aligned substantially horizontally, adjoins thereon. The substantially horizontally formed section 643' can have a length of greater than 5 cm, in particular greater than 10 cm, so that a bus tire 53 can drive on the horizontal section 643' at least with a substantial part of the width. Substantial weight forces are thus loaded on the curbstone 6' by the bus tire 53, which contributes to the stability, in particular if a flank of the bus tire 53 drives onto the inclined surface 645 at high speed. This also prevents the curbstone 6" from being shifted or pivoted even in the event of frequent approach. In addition, rutting is thus also prevented. The base width having the section 643' can be adapted so that the front edge is flush with an existing drainage gutter.

An edge 642', which is located approximately at the roadway level s, adjoins the substantially horizontally extending section 643'. The substantially vertical installed section 641' is located below the top edge 642'. The vertical installed section 641' can be arranged to the rear side 61 such that the curbstone 6" spreads outward slightly directed downward.

FIG. 11 shows a stop according to the invention having a sidewalk region G, a first ramp R, an approach region A, a second ramp R, and an entry region E. Standardized curbstones 8 are provided in the sidewalk region G, adjacent to which a drainage gutter 80 is provided on the side oriented toward the roadway 4. As is obvious in FIG. 11, the front edge of the drainage gutter 80 facing toward the roadway 4 is aligned with a front edge of the horizontal sections 1043', 743', 943', and 643' of the curbstones 10, 7, 9, and 6". The horizontal sections 1043', 743', 943', and 643' are formed wider than shown in FIGS. 3 to 9, approximately as wide as shown in FIG. 10 for the curbstone 6". The drainage function can thus be maintained in the region of the stop.

When the bus driver approaches the bus stop 1 according to the invention (FIG. 1), the approach region A is approached first, which is set off visually from the adjacent pavement region G. The curbstones 7 of the approach region A are formed having a height of preferably less than 16 cm, so that the vehicle body 52 of common bus types can travel over these curbstones 7 without being damaged. The curbstones 7 nonetheless have a guidance function through the bottom concavely curved section 744 and the adjoining inclined surface 745, which typically prevents damage to a bus tire 53 or driving of the bus tire up onto the curbstone 7. If the bus now drives over the approach region A to the entry region E, the inclined position of the bus 5 changes relative to the longitudinal direction of the curbstones 6 or 7, respectively, until the bus 5 is aligned parallel thereto. In the entry region E, the vehicle body 52 protruding laterally over the bus tire is therefore arranged closer to the roadway 4 than in the approach region A. The curbstones 6, 6', or 6" can thus be formed higher in the entry region E without problems, without the danger arising that the vehicle body 52 will collide in this region with the curbstone 6, 6', or 6". The concavely curved section 647 or 647' offers an additional safeguard for this purpose.

The bus driver, from the approach region A via the ramp R and the entry region E, can easily steer the bus 5 slightly toward the curbstones 7, 9, and 6, since they are formed in the bottom region having the same cross section and each have curved sections 744, 944, and 644 and inclined surfaces 745, 945, and 645. The bus driver can thus readily achieve an optimum alignment of the bus relative to the stop 1 in the entry region E.

LIST OF REFERENCE NUMERALS

1 bus stop
2 surface
3 sidewalk
4 roadway
5 bus
6, 6', 6" curbstone
7 curbstone
8 curbstone
9 curbstone
10 curbstone
21 walkway
22 ramp

23 walkway
24 ramp
51 door
52 vehicle body
53 bus tire
61 rear side
62 bottom side
63 top side
64 front side
71 rear side
72 rear side
73 top side
74 front side
91 rear side
92 bottom side
93 top side
94 front side
101 rear side
102 bottom side
103 top side
104 front side
641, 641' installation section
642 top edge
643, 643' horizontally extending section
644 concavely curved section
645 inclined surface
646, 646' convexly curved section
647, 647' concavely curved section
648 convexly curved section
741 bottom installation section
742 top edge
743 horizontally extending section
744 concavely curved section
745 inclined surface
746 convexly curved section
747 concavely curved section
748 convexly curved section
941 installation section
942 top edge
943 horizontally extending section
944 concavely curved section
945 inclined surface
946 convexly curved section
947 concavely curved section
948 convexly curved section
1041 section
1042 top edge
1043 horizontally extending section
1044 concavely curved section
1045 inclined surface
1047 concavely curved section
1048 convex section
1049 plane
1050 inclined surface
A approach region
E entry region
G sidewalk region
R ramps
S roadway level

The invention claimed is:

1. A curbstone (6, 7, 9, 10), having a top side (63, 73, 93, 103) used as a step-on surface, a front side (64, 74, 94, 104) used as a delimitation, a rear side (61, 71, 91, 101), and a bottom side (62, 72, 92, 102), the front side (64, 74, 94, 104) having a bottom installation section (641, 741, 941, 1041) having a top edge (642, 742, 942, 1042) and a top section adjoining the top edge (642, 742, 942, 1042), which is provided with an inclined surface (645, 745, 945, 1045), which is set back increasingly from bottom to top in the direction of the rear side (61, 71, 91, 101), and which merges in its lower region into a concavely curved section (644, 744, 944, 1044), which extends in a substantially level section (643, 743, 943, 1043), which extends nearly horizontally in the installed state, up to the top edge (642, 742, 942, 1042), characterized in that the front side (64, 74, 94, 104) has, above the inclined surface (645, 745, 945, 1045), a second concavely curved section (647, 747, 947, 1047), which is increasingly set back from bottom to top in the direction of the rear side (61, 71, 91, 101) and, the concavely curved section (644, 744, 944) adjoins the inclined surface (645, 745, 945), which operate to guide a bus wheel coming into contact therewith in an installed state.

2. The curbstone (1) according to claim 1, characterized in that the inclined surface (645, 745, 945, 1045) merges via a convexly curved section (646, 746, 946, 1046) into the second concavely curved section (647, 747, 947, 1047).

3. The curbstone (1) according to claim 1, characterized in that the second concavely curved section (647, 747, 947, 1047) merges via a second convexly curved section (648, 748, 948, 1048) into the top side (63, 73, 93, 103).

4. The curbstone (1) according to claim 1, characterized in that the second concavely curved section (647, 747, 947, 1047) merges in the direction of the top side (63, 73, 93, 103) into a second inclined surface.

5. The curbstone (1) according to claim 1, characterized in that the second concavely curved section (647, 747, 947, 1047) has a radius of 80 mm to 120 mm.

6. The curbstone (1) according to claim 1, characterized in that the second concavely curved section (647, 747, 947, 1047) extends over an arc of 20° to 90°.

7. The curbstone (1) according to claim 1, characterized in that the height difference between the top edge (642, 742, 942, 1042) of the lower installation section (641, 741, 941, 1041) and the top side (63, 73, 93, 103) is between 12 cm and 28 cm.

8. The curbstone (1) according to claim 7, characterized in that the height difference between the top edge (642, 742, 942, 1042) of the bottom installation section (641, 741, 941, 1041) and the top side (63, 73, 93, 103) is 12 to 16 cm.

9. The curbstone (1) according to claim 7, characterized in that the height difference between the top edge (642, 742, 942, 1042) of the bottom installation section (641, 741, 941, 1041) and the top side (63, 73, 93, 103) is 21 cm to 28 cm.

10. A stop (1) for bus traffic, in particular for combined rail/bus traffic, having a surface (2) and a roadway (4), the delimitation of the surface (2) to the roadway (4) being formed by multiple curbstones (6, 7, 9, 10), characterized in that the curbstones (6, 7, 9, 10) are formed according to claim 1.

11. The stop according to claim 10, characterized in that the surface (2) has an elevated approach region (A) in relation to a sidewalk region (G) adjacent to the stop.

12. The stop according to claim 10, characterized in that the surface of an entry region (E) is elevated in relation to the surface of an approach region (A).

13. The stop according to claim 11, characterized in that the surface between the sidewalk region (G) and the approach region (A) has a ramp (24) rising to the height level of the approach region (A) and/or a ramp (22) rising to the height level of the entry region (E) between the approach region (A) and the entry region (E).

14. The stop according to one of claim 10, characterized in that the curbstones (6, 6', 6", 7, 9) of the entry region (E), a ramp (R), and the approach region (A) adjacent to the roadway (4) comprise the concavely curved section (644, 744, 944) and the adjoining inclined surface (645, 745, 945) for the guidance of a bus (5).

15. The stop according to one of claim 10, characterized in that a front edge of a drainage gutter (80) facing toward the roadway (4) is aligned with a front edge of the horizontal sections (643', 743', 943', 1043') of the curbstones (6", 7, 9, 10).

* * * * *